United States Patent [19]

Lambert, Jr.

[11] 4,167,795

[45] Sep. 18, 1979

[54] MOTION SUPPRESSING FLUID MATTRESS

[75] Inventor: Everette M. Lambert, Jr., San Jose, Calif.

[73] Assignee: Liberty Vinyl Corporation, Santa Clara, Calif.

[21] Appl. No.: 896,258

[22] Filed: Apr. 14, 1978

[51] Int. Cl.[2] ..... A47C 27/08

[52] U.S. Cl. ..... 5/458; 428/182; 428/185

[58] Field of Search ..... 5/367, 370, 365, 349, 5/350, 341; 297/DIG. 3; 128/376; 428/178, 182, 184, 185, 186

[56] References Cited

U.S. PATENT DOCUMENTS

| | | | |
|---|---|---|---|
| 2,887,692 | 5/1959 | Gosman | 5/349 |
| 3,462,330 | 8/1969 | Greig et al. | 428/178 |
| 3,848,282 | 11/1974 | Viesturs | 5/349 |

*Primary Examiner*—Mervin Stein
*Assistant Examiner*—Alexander Grosz
*Attorney, Agent, or Firm*—Townsend and Townsend

[57] ABSTRACT

A fluid-filled bladder-type mattress includes a plurality of panels periodically disposed at oblique angles between upper and lower surface members of the bladder mattress for suppressing motion. In one preferred embodiment, a single bladder chamber is filled with a liquid fluid, and panels comprising a plurality of planar membrane members are bonded along angular lines alternately and at oblique angles to the upper and lower surface members of the bladder in a herringbone bonding pattern to provide an open inner structure promoting wave energy dispersion and dissipation. A mattress embodying the invention minimizes horizontal motion and fluid wave propagation.

8 claims, 3 Drawing Figures

MOTION SUPPRESSING FLUID MATTRESS

BACKGROUND OF THE INVENTION

1. Field of Invention

This invention relates to fluid-filled bladder-type mattresses such as waterbed mattresses and air mattresses, and particularly to bladder mattresses adapted to suppress undesired lateral and vertical motion of the mattress and undesired fluid wave motion.

Suppression of bed motion is desired in both air and waterbed mattresses. Discomfort, difficulty in movement and nausea may result from excessive bed motion.

Undesired motion is not only a concern in the more conventional applications and use of fluid-filled beds, it is particularly a problem in fluid-filled beds used for emergency purposes where motion of a bed supporting an injured person may aggravate injury.

2. Description of the Prior Art

Waterbed and air mattresses are known wherein motion is suppressed or minimized. Conventional air mattresses comprise, for example, an array of tubular sections formed by bonding the upper surface member to the lower surface member and wherein the sections are in fluid communication through selected constructions. Such a mattress is particularly susceptible to buckling along the bonding ribs, which is undesirable, particularly of an air mattress in emergency or disaster applications where bed movements and buckling may aggravate injury or render transport of a patient more difficult.

The problem of wave motion in waterbed mattresses is well-known. Three techniques are known for wave motion suppression in liquid-filled bladders. The first technique involves use of a fluid other than water which is characterized by a high viscosity and inherent damping characteristics. A second technique involves inclusion of energy absorbing means within the bladder. A third technique involves isolation of the fluid within compartments of the mattress.

All of these techniques exhibit particular disadvantages. The high viscosity fluid is generally expensive and not readily available. Further, the fluid may present a hazard if the bladder ruptures. Still further, the fluid may not be readily disposable.

A popular energy absorbing technique known to the art involves the use of wave motion absorbing cylinders within the bladder. However, undesired gas bubbles tend to be trapped within the cylinders and to be released into the bed, thereby creating gas pockets.

The use of barriers to compartmentalize the fluid is only partially effective. Wave motion can readily propagate through most pliant barriers known to the art. Moreover, relatively rigid barriers detract from the known desirable characteristics of liquid fluid-filled mattress, for example, by creating non-uniformities in the support properties of the mattress. Still further, fully compartmentalized structures require individual filling of each compartment. Therefore, except for bifurcated structures (double twin mattresses) provided with absorbent barriers, compartmentalized structures have not been well received.

What is therefore needed is a mattress structure which is capable of suppressing waves as well as any motion in the mattress structure without detracting from the support characteristics of the mattress.

SUMMARY OF THE INVENTION

According to the invention, a fluid-filled bladder-type mattress includes a plurality of pliant panels periodically disposed at oblique angles between upper and lower surface members of the bladder mattress for suppressing motion. In the preferred embodiment of a liquid fluid-filled bladder, a single bladder chamber includes a plurality of planar membrane panel members bonded along angular lines alternately and obliquely to the upper and the lower surface members of the bladder to define a herringbone-type surface bonding pattern. The pattern of panel arrangement has been found to contribute significantly to suppression of liquid fluid wave propagation by dispersing, canceling and dissipating the periodic wave energy.

BRIEF DESCRIPTION OF THE DRAWINGS

The invention will be better understood by reference to the following detailed description of preferred embodiments in conjunction with the drawings wherein.

DETAILED DESCRIPTION OF PREFERRED EMBODIMENTS

Figure 1:
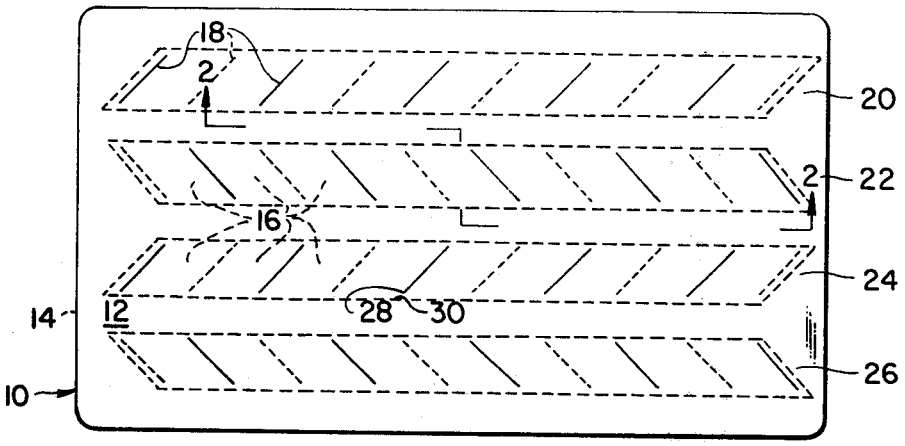
FIG. 1 is a top plan view of a first embodiment of the invention.

Referring to FIG. 1, there is shown a bladder-type mattress 10 adapted for containing a fluid medium such as water or air. In the particular preferred embodiment disclosed in FIG. 1, the mattress 10 is best suited to contain water for reasons hereinafter explained.

Figure 2:
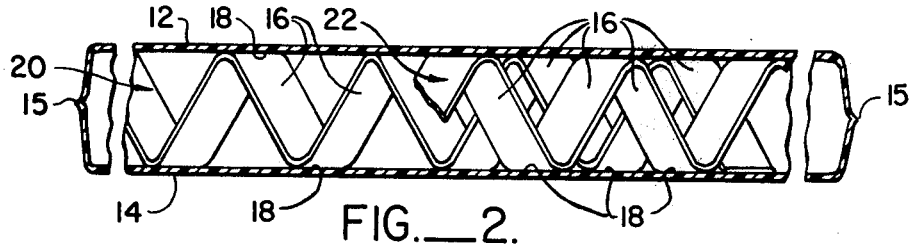
FIG. 2 is a side cross sectional view of FIG. 1 along section line 2—2.

Referring to FIG. 1 and FIG. 2 together, the mattress is seen to comprise an upper surface member 12 and a lower surface member 14. Typically the surface members 12, 14 are made of a pliant vinyl sheet material such as polyvinylchloride (PVC) substantially impervious to fluid leakage. The upper surface member 12 and lower surface 14 may be sealingly joined at a side margin 15 to define a fluid tight bladder.

According to the invention there is provided within the bladder mattress 10 a plurality of panels 16 disposed interior to the mattress 10 at oblique angles between the upper surface member 12 and the lower surface member 14. The purpose of the panels 16 is to suppress the motion of the mattress 10.

The panels 16 preferably comprise a pliant sheet material, such as PVC and are attached to the upper surface member 12 and to the lower surface member 14. When the bladder mattress 10 is inflated, the panels 16 are tightly drawn between the upper surface member and the lower surface member. Preferably, the panels 16 are bonded to the respective upper surface member 12 and lower surface member 14 along linear ribs 18 formed by the fusion of the sheet material of the panels 16 with the upper surface member and lower surface member 12, 14. The panels 16 are preferably formed of a single elongate sheet, and the ribs 18 are preferably disposed in a column array 20 such that the panels 16 define a periodic alternating zigzag pattern of panels 16 between the upper surface member 12 and the lower surface member 14. According to the invention, therefore the ribs 18 and the panels 16 of the mattress 10 adapted to hold water or other liquid are disposed in an oblique angle pattern. Specifically, the ribs 18 are disposed in at least a first column array 20 and second column array 22, the second column array 22 being parallel to the first column array 20, and the ribs of each of the column array 20, 22 being parallel within the column array and oblique to the axes of the respective column array 20, 22. In the top plan view (FIG. 1) the ribs 18 define a herringbone or tractor tire pattern. Viewed in side cross section (FIG. 2) the panels 16 present an oblique face. This disposition is adapted to alternately deflect liquid wave energy transversely incident to the axes of the column array 20, 22 upwardly or downwardly and laterally.

Several column arrays 20, 22 and also 24 and 26 are preferred in the liquid-filled mattress 10. Wide width mattresses, such as double, queen and king sizes typically have four to six columns. Generally, at least two different angular dispositions of ribs 18 are preferred. It has been observed that at least two rows of ribs 18 disposed in columns with the sense of the ribs 18 of one column arranged substantially perpendicular to the sense of the ribs in another column produce optimal results. For example, liquid waves incident on one column of panels 16 are not only reflected and dispersed, they appear to be canceled and dissipated, and the resultant waves appear to be channeled to the second column where the panels 16 (disposed with the sense of the ribs 18 arranged to be substantially perpendicular to incident waves) further reflect, disperse, dissipate and cancel the wave energy of the liquid. It has thus been observed that waves are rapidly suppressed and a substantially stable liquid support bed is obtained in a mattress constructed according to the invention.

A specific preferred embodiment of a queen-size mattress 10 comprises an upper surface member 12, lower surface member 14, four column arrays 20, 22, 24 and 26 disposed in parallel the length of the mattress and defining panels 16 zigzagging between the upper surface member 12 and lower surface member 14 with linear bonding ribs 18 disposed at approximately 45 degrees to the axes of the column arrays 20, 22, 24 and 26 and perpendicular to the ribs 18 of the adjacent column arrays. The column arrays 20, 22, 24 and 26 may be laterally separated from the lateral sides of the mattress 10 and from one another by approximately the width of the column array. Each of the column arrays is on the order of 8 to 18 inches wide and preferably about 12 inches wide. The ribs 18 of one column array are also disposed to be linearly offset from the ribs 18 of the adjacent column arrays, as is illustrated in FIG. 1.

Figure 3:
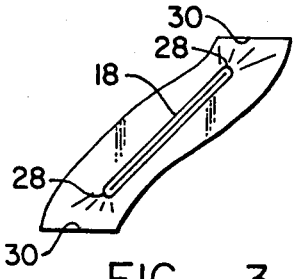
FIG. 3 is a top plan view of a rib construction according to the invention.

Each of the ribs 18 preferably has rounded or blunt end 28 at the extrema of the bond with the surface members 12, 14, as shown in FIG. 3. The ribs 18 are approximately $\frac{3}{4}$ inch wide by about 8 to about 18 inches long. The panels therefore include loose side margins or flaps 30, as shown in FIG. 5, extending about $\frac{1}{2}$ to about 2 inches beyond the extrema of the ribs 18. These flaps 30 serve to disperse the tension load at the bond end as between the ribs 18 and the panels 16 to reduce the possibility of rip damage to the mattress material.

The invention has now been described with reference to specific preferred embodiments. Other embodiments will be apparent to those with ordinary skill in the art. For example, individual panels 16 may be bonded at oblique angles between the upper surface member 12 and the lower surface member 14 in random or other suitable patterns. In the embodiments herein disclosed, column arrays 20 are preferred because of the ease of bonding an elongate sheet of vinyl material between the upper and lower surface members. Alternatively, the panels 16 may be rigid members attached to only one side, for example, the upper surface member 12, or the panels 16 may be suspended on a support member such as a cord stretched between the lateral sides of the mattress 10. It should be noted that pliant panels are generally preferred because rigid members can introduce nonuniformities into the surface characteristics of the mattress 10. Moreover, a pliant member can extend between the upper surface member and the lower surface member and be attached thereto to provide tension support resisting relative lateral motion of the upper surface member 12 and lower surface member 14, particularly in the case of the air mattress 100 embodiment of FIGS. 3 and 4. Therefore, it is not intended that the invention be limited, except as indicated by the claims appended hereto.

I claim:

1. A bladder mattress for containing a fluid medium comprising:

an upper surface member;

a lower surface member; and a plurality of panels of pliant sheet material, wherein each of said panels is bonded along linear ribs to said upper surface member and to said lower surface member and wherein said ribs are disposed in at least two substantially parallel column arrays defining a periodic alternating zigzag pattern between said upper surface member and said lower surface member and wherein said ribs in one column array are disposed at an angle defining a herringbone pattern relative to the ribs of adjacent column arrays for suppressing motion of said mattress.

2. A bladder mattress as claimed in claim 1 wherein said ribs are disposed at approximately forty-five degrees to longitudinal axes of said column arrays and wherein the ribs of each column array are disposed at an angle approximately perpendicular to the ribs of adjacent column arrays.

3. A bladder mattress as claimed in claim 1 wherein said ribs of a first one of said column arrays are offset from said ribs of a second one of said column arrays with respect to an axis perpendicular to said column array.

4. A bladder mattress as claimed in claim 1 wherein said column arrays are laterally separated from one another by substantially the width of one of said column arrays.

5. A bladder mattress as claimed in claim 1 wherein each one of said ribs defines rounded end bonds with said upper surface member and said lower surface member and wherein each of said panels includes flaps extending laterally of each of said end bonds.

6. In a fluid containing bladder mattress having a hollow inflatable body portion of flexible sheet material defining an upper surface member and a lower surface member, the improvement comprising a plurality of pliant panels disposed in periodic patterns at oblique angles between said upper surface member and said lower surface member, said panels being bonded to said upper surface member and to said lower surface member along linear ribs, wherein said ribs of each one of said periodic panels on each one of said surface members are disposed at an oblique angle to said ribs of adjacent periodically disposed panels on said same surface member thereby to define a herringbone pattern in said upper surface member and in said lower surface member.

7. A bladder mattress for containing a fluid medium comprising:

an upper surface member;

a lower surface member; and a plurality of parallel spaced column arrays comprised of a pliant sheet material panel bonded alternately to the upper and lower surface member with linear bonding ribs alternately disposed between said upper surface member and said lower surface member in a herringbone pattern.

8. The mattress as claimed in claim 7 wherein said ribs of said column arrays are disposed at approximately forty-five degrees to the longitudinal axes of said column arrays and approximately perpendicular to said ribs of an adjacent one of said column arrays.

* * * * *